United States Patent [19]

Shibata

[11] 4,367,667

[45] Jan. 11, 1983

[54] FRENCH FRY CUTTER FOR FOOD PROCESSORS

[75] Inventor: Koichiro Shibata, Seto, Japan

[73] Assignee: Cuisinarts, Inc., Greenwich, Conn.

[21] Appl. No.: 238,974

[22] Filed: Feb. 27, 1981

[51] Int. Cl.[3] ..... B26D 7/00

[52] U.S. Cl. ..... 83/356.3; 83/591; 83/592; 241/92

[58] Field of Search ..... 83/356.3, 356.1, 355, 83/592, 591; 241/92

[56] References Cited

U.S. PATENT DOCUMENTS

| | | | |
|---|---|---|---|
| 1,965,501 | 7/1934 | Knott | 83/592 X |
| 3,783,727 | 1/1974 | Brignard | 83/356.3 X |
| 4,198,887 | 4/1980 | Williams, Jr. | 83/356.3 |
| 4,256,265 | 3/1981 | Madan | 83/356.3 X |

*Primary Examiner*—James M. Meister

*Attorney, Agent, or Firm*—Parmelee, Bollinger & Bramblett

[57] ABSTRACT

A French fry rotary cutter tool is provided for use in food processors having a hub removably engageable with the drive means of the food processor and a disc-like member secured to the hub having an opening extending from a region near the hub to a region near the periphery with an elevated portion located behind the opening. A cutting structure is positioned in the opening for producing multiple, elongated rectangular cuts in food applied thereto which pass through the opening into the bowl of the processor. The cutting structure is formed of a continuous strip of blade metal bent into a rectangular-wave shape having alternating, spaced flat, lower and lower portions which are secured, respectively, to the underside and elevated portions of the disc-like member. The bent strip defines a plurality of spaced, parallel blades which have a square-wave appearance. The leading edge of the blade strip is sharpened before it is bent into shape such that sharp edges face the direction of rotation of the disc for simultaneously producing horizontal and vertical cutting in food items for forming elongated, rectangular shaped French fry cuts. The cutting structure is ruggedized by a flat blade element with a sharpened leading edge mounted on and projecting forward from the elevated portion of the disc-like member, and the trailing edges of the blade strip have rearwardly extending integral tongues respectively secured to said flat plate-like element and to integral rearwardly extending tongues of said disc-like member.

16 Claims, 4 Drawing Figures

FRENCH FRY CUTTER FOR FOOD PROCESSORS

BACKGROUND OF THE INVENTION

This invention relates to rotary tools for food processors, and more particularly to a French fry cutter tool for uniformly and cleanly cutting and slicing food items into elongated, rectangular shaped French fry cuts and similar types of cut food items.

Food processors to which the present invention relates are characterized by having a working bowl mountable on a base with tool drive means extending into the bowl for rotating a food processing tool in the bowl. Various selected rotary tools can be engaged on and driven by the drive means for performing many different food processing operations, as may be desired by the user. A detachable cover is secured over the top of the bowl during use, and the cover includes a hopper or feed tube which has a passageway extending downwardly through the cover into the bowl. Food items to be prepared may be placed in the feed tube and are then manually pushed down through the feed tube into the bowl by means of a removable pusher member which is adapted to slide down into the feed tube in the manner of a plunger. Further information with respect to food processors and their tools may be obtained by reference to U.S. Pat. Nos. 3,985,304—Sontheimer; 4,198,887—Williams; 4,200,244—Sontheimer; 4,216,917—Clare and Sontheimer; and 4,227,655—Williams.

The various interchangeable rotary tools which may be used in the food processor include slicing discs, grating discs, rasping discs, etc. which have a disc-like tool member formed of sheet metal, preferably of stainless steel, with one or more cutting elements projecting above the upper surface of the disc. These tools with their disc-like cutting member are intentionally positioned in the top of the bowl near the lower surface of the cover where they can perform the cutting operations on the food items introduced downwardly from the feed tube into the top of the bowl.

For the purpose of positioning the disc-like member in the top of the bowl, such a rotary tool may have a relatively long hollow hub extending down into the bowl which slides down into engagement around tool drive means or otherwise provides a driving connection between the tool hub and drive means extending into the bowl, to facilitate the quick and convenient mounting and replacement of the various disc-like cutting tools.

The present invention is directed to the type of rotary cutting tool which cuts food items such as potatoes, fruits, vegetables and other food items into elongated, rectangular-shaped French fry cuts or similar cuts.

As used herein the terms "French fry cuts" and "the cuts" are intended to mean the resulting elongated, rectangular stick-like pieces of the food after having been sliced by the rotating cutting tool. These French fry cuts are characterized by each having a rectangular or square cross section which requires the item to be sliced simultaneously along perpendicular planes. The French fry cut may be similar to, but are normally considerably larger in cross section than, julienne strips, and thus, French fry cuts require an entirely different, rugged cutting structure.

U.S. Pat. No. 4,198,887 entitled "Julienne Cutter Tool," describes one type of rotary disc tool for cutting julienne strips from food items. The present invention is directed to improvements in a French fry disc type of cutting tool.

SUMMARY OF THE INVENTION

It is an object of the present invention to provide a new and improved French fry rotary cutter tool for food processors which will repeatedly process food items applied thereto into clean, crisp, neat and uniform elongated rectangular shaped cuts or similar French fry cuts having a rectangular or square cross section.

A further object of this invention is to provide a new and improved French fry cutter tool for food processors which is rugged, reliable and easier to fabricate than existing French fry rotary cutter tools.

In carrying out this invention in one illustrative embodiment thereof, a French fry cutter tool is provided for use in rotary food processors of the type described above. The French fry cutter tool has a hub removably engageable with drive means in the working bowl to be rotated in a predetermined direction about an axis. The disc-like member has an opening therein extending from a region near the hub to a region near the periphery of the disc-like member. Behind this opening, with respect to the direction of rotation, there is an elevated platform portion of the disc-like member which defines the region located behind the opening.

A cutting structure is positioned in the opening for producing multiple, substantially evenly spaced, simultaneous horizontal and vertical cutting in the food items applied thereto, with the resulting elongated, rectangular cuts of food passing through the opening into the bowl. The cutting structure employs a continuous strip of blade metal bent into a rectangular-wave shape (rectangular zig zag shape) and having alternating, spaced, flat lower portions and spaced, flat upper portions interconnected by upright, parallel blade portions whereby the continuous blade strip has the general configuration of a square wave as seen looking in front elevation or rear elevation. The lower portions of the bent blade strip are secured to the underside of the disc-like member near the leading edge of the opening as defined by the direction of rotation, and the elevated upper portions of the bent blade strip are secured to a horizontal flat plate-like blade mounted on the elevated platform portion of the disc-like member.

The leading, cutting edge of the blade strip is sharpened before it is bent into shape, and therefore each of the upright blades and each of the flat upper blade portions of the cutting structure have sharp leading edges facing forward in the direction of rotation, whereby said blades in cooperation with the sharp leading edges of the elevated flat portions simultaneously produce horizontal and vertical cutting in food items applied thereto for forming elongated rectangular French fry cuts or similar types of food cuts, which are clean, crisp, neat and uniform.

Additionally the cutting structure is provided with a flat plate-like blade element with a sharpened leading edge which is mounted on the elevated platform projecting forward overlying the opening in said disc-like member. The elevated flat portions of the bent blade strip have integral rearwardly extending tongues in the direction of rotation which are affixed to the upper surface of the plate-like blade element whose leading edge abuts the trailing edges of the spaced parallel blades.

Advantageously, the rugged nature of the cutting structure provides strength for the entire French fry disc by virtue of being mounted in the opening in the disc extending both above and below the disc with the multiple blades spanning across between the front and rear edges of the opening like multiple braces for resisting deformation of the opening under the stress of continual impact of such an opening with the food items which are being sliced. The flat plate-like blade element and integral tongue mounting structure further ruggedize the cutting structure. The rugged nature of the formation of the cutting structure enhances the performance of this French fry disc tool through repeated use and provides for uniform, clean-cut, elongated, rectangular, French fry cuts after repeated use.

BRIEF DESCRIPTION OF THE DRAWINGS

The invention together with further objects, aspects and advantages thereof, will become more clearly and fully understood from the following description considered in conjunction with the accompanying drawings, in which the same reference numbers are used to indicate the same elements or components throughout the various Figures.

DESCRIPTION OF THE PREFERRED EMBODIMENTS

Figure 1:
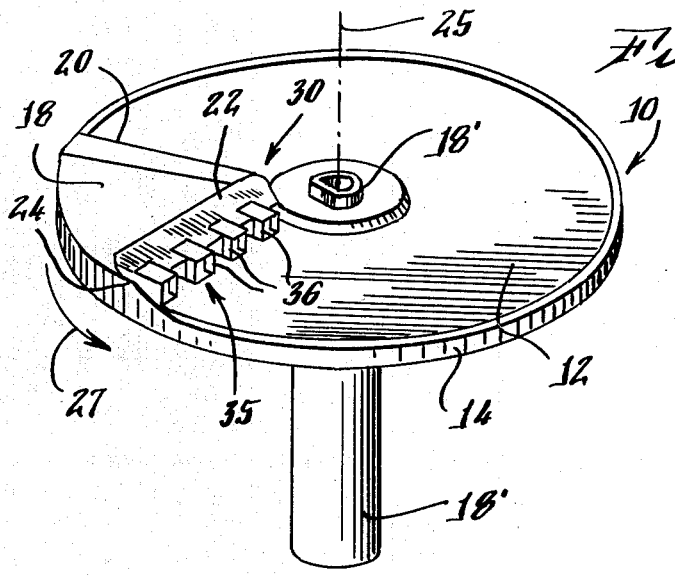
FIG. 1 is a perspective view of a new and improved French fry rotary cutter tool embodying the present invention for use in food processors.

Referring now to FIG. 1, a rotary French fry cutter tool, referred to generally with the reference number 10, includes an elongated hub portion 18 which is removably engageable upon a tool drive means (not shown) for producing a relatively high speed rotation in the range from 700 to 1,800 RPM of the cutter 10 around a vertical axis 25 in the direction indicated by the arrow 27. This French fry cutter is adapted to be mounted in a food processor of the type shown and described in the aforesaid patents. Since the invention resides in the French fry rotary cutter tool per se, the remaining structure of a food processor is not further described herein.

Figure 4:
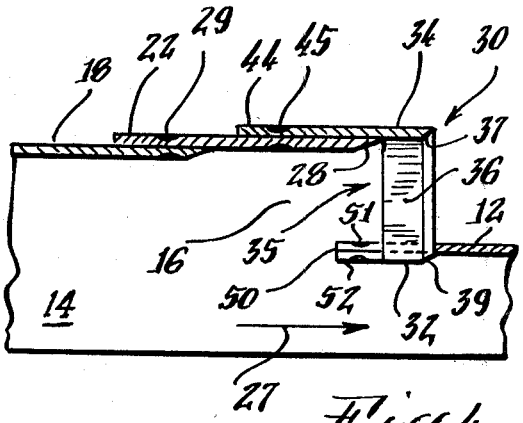
FIG. 4 is a further enlarged cross-sectional view taken along line 4—4 in FIG. 3.
Figure 3:
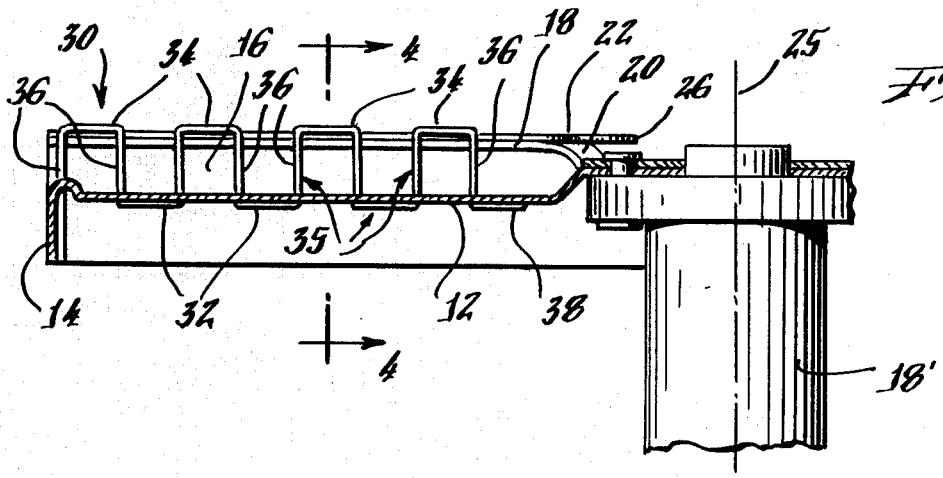
FIG. 3 is a cross-sectional view taken along line 3—3 in FIG. 2.

The French fry cutter 10 includes a disc-like member 12 of stainless steel having a stiffening peripheral flange or rim 14. As is best seen in FIG. 3, the disc 12 includes an elongated and relatively narrow opening or slot 16 which extends from a position near the hub 18 out to a position near the peripheral rim 14. The disc 12 is displaced upwardly by a stamping operation to provide an elevated platform 18 which is elevated above the disc-like member 22. This elevated platform 18 slopes downwardly to the level of the disc in a sloping shoulder 20. This elevated platform 18 extends parallel with the plane of the disc-like member 22 and forms the upper trailing edge of the opening 16 as best seen in FIG. 4. The top surface of the elevated platform 18 is elevated significantly above the main area of the top surface of the disc 22 accommodating the slot or opening 16 in the disc as will best be seen in FIG. 3.

It is within the slot 16 that the French fry cutting structure, referred to generally with the reference numeral 30, is positioned and affixed. The French fry cutting structure 30 includes a flat, horizontal, plate-like blade element 22 generally conforming on the outer edge 24 thereof to the curvature of the rim 14 while the inner edge 26 is generally curved conforming to the curvature of the hub 18. The leading edge of this blade element 22 facing the direction of rotation 27 is sharpened, and this blade element 22 is spot welded on the top of the platform 18 at a plurality of spots 29.

The cutting structure 30 also includes, as its principle element, as best seen in FIG. 3, a unitary continuous strip 35 formed from a sheet of blade metal bent into a rectangular-wave shape (rectangular zig-zag shape) and having spaced, flat lower portions 32 and spaced, flat elevated upper portions 34. The spaced lower portions 32 and the spaced upper portions 34 are also radially separated along the disc 12.

This bent blade strip advantageously defines a plurality of spaced, upright, parallel blades 36 extending upwardly, generally perpendicular to, and located between and integral with the spaced flat lower and spaced flat upper portions, 32 and 34 respectively, of the cutting structure 30.

The leading cutting edge of the blade strip is sharpened before it is bent into shape, and therefore each of the upright blades 36 and each of the flat upper portions 34 (and also each of the flat lower portions 32) have sharp leading edges. This sharpening is advantageously done by grinding on one side only of the blade strip. Thus, as seen in FIG. 4, the cutting edge per se 37 slopes advantageously downwardly, and the forwardmost portion of this cutting edge is flush with the top surface of the flat upper portion 34. Thus, also, the leading edge 39 (FIG. 4) of the lower flat portions 32 slope rearwardly downwardly so that it merges with the lower surface of the disc member 12.

The upright spaced, parallel blades 36 are positioned in the opening 16 of the disc 12 and are spaced radially therein with respect to the axis of rotation. The outermost blade 36 located adjacent to the rim of the disc 14 is elongated at 37 and is spot welded to the inside of the rim 14. The entire leading edge of the initial blade 36 including its extension 37 is sharpened as discussed above so that a clean crisp cut is made as well as insuring a firm attachment to the rim 14. The unitary cutting element 35 as viewed in the direction of rotation or from behind is castellated in appearance or has the appearance of a symmetrical square wave, i.e. a rectangular zig-zag. The cutting structure 35 is terminated on the inner end thereof near the hub 18 in a flat lower portion 38 which is spot welded to the underside of the disc 12 ahead of the opening 16.

Figure 2:
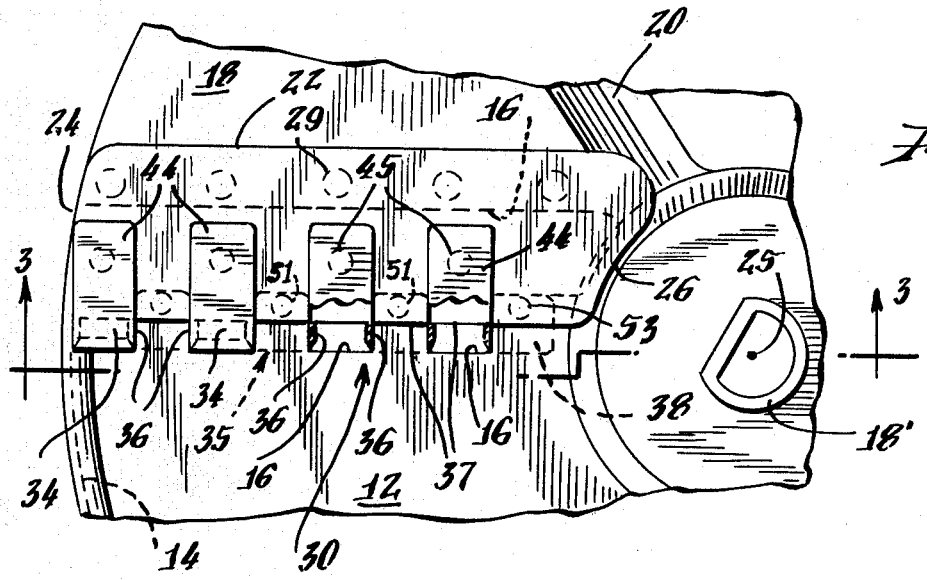
FIG. 2 is an enlarged top view of the French fry cutter tool of FIG. 1 particularly illustrating the cutting structure.

There is a strong and easy to assemble construction which will permit the cutting structure 30 of the French fry cutting tool 10 to withstand the high speed slicing actions occurring during operation. As seen in FIGS. 1, 2 and 4 the upper elevated flat portions 34 of the blade strip include relatively large strong trailing tongues 44 which are spot welded at spots 45 to the plate-like blade element 22 (see FIG. 2). These spot welds 45 are advantageously located directly over the centerline of the elongated opening 16 which facilitates access of the lower electrode of the spot welder to the lower surface of the plate-like blade element 22. As seen in FIG. 4 the sharpened leading edge 28 of the plate-like blade element 22 abuts against the trailing edges of upright parallel blades 36. This cutting edge 28 is sharpened by grinding only the lower surface of the blade element 22 near the edge, thus producing a forwardly upwardly sloping cutting surface in which the forwardmost tip of the edge is flush with the top surface of the blade element. Consequently, the cutting edge 28 in action merges with the lower surface of the flat portions 34 for effectively horizontally cutting the food.

The blades 36 provide cutting edges which form a row of parallel, vertical, radially spaced knife edges, this row of blades extending radially near the opening 16 for vertically cutting the food along radially spaced lines as will be understood from the front elevation of the cutting structure shown in FIG. 3.

The assembled cutting structure 30 (FIG. 3) provides a series of square or rectangular shaped openings 48 extending in a row radially outwardly from near the hub 18 to a position near the periphery of the disc 12 thus occupying substantially the entire length of the opening 16 in the disc 12.

The lower flat portions 32 of the bent blade strip are attached to the disc 12 as best illustrated in FIG. 4. The disc 12 has a plurality of spaced tongues 50 which extend rearwardly into the opening 16 and are designed to project between the upright blades 36 into the areas above the flat lower portions 32 of the continuous bent blade strip. The lower flat portions 32 of this continuous blade strip also have rearwardly extending tongues 52 which are aligned with the disc tongues 50. These blade strip tongues 52 are spot welded at 51 to the bottom surfaces of the rearwardly extending tongues 50. This particular mounting arrangement with tongues 52 below tongues 50 removes the flat lower portions 32 of the bent blade strip from the path of the food items which are being fed into the cutting structure 30, thus providing a smooth upper surface on the disc 12 which is unobstructed as the food is approached by the rotating cutting structure 30. Also, by virtue of having the rearwardly projecting tongues 50 and 52 the spot welded regions 51 are conveniently accessible to both the upper and lower spot welding tools, as will be understood from FIG. 2.

Advantageously, the cutting structure 30 is comprised of only two elements; namely, the flat plate-like blade element 22 which is sharpened on its leading edge and the continuous blade strip 35 sharpened on its leading edge and bent into a rectangular wave shape (rectangular zig-zag shape). The outer end 37 of the bent blade strip 35 is mounted flush against the inner surface of the rim 14, being spot welded to the rim. The inner end of the bent blade strip includes a tongue which is spot welded at 53 for anchoring the inner end of this blade strip.

Accordingly, a French fry rotary cutting tool 10 has been described which has a rugged construction and is convenient to manufacture, and it produces clean, neat, attractive French fry cuts. The blades 36 are connected to both the upper and lower structures of the cutting tool and are further strengthened by the plate-like blade element 22 such that the blades are not deflected by the impact of cutting rather large rectangular square-shaped cross sectional cuts, for example on the order of 6 by 6 millimeters.

It is to be understood that the hub may be offset from the center of the disc 12 in a direction away from the opening 16 in order to accommodate a larger more elongated cutting structure 30 in a given diameter of the disc 12.

Since other changes and modifications varied to fit particular French fry cutting tool operating requirements will be apparent to those skilled in the art, the invention is not considered limited to the example chosen for purposes of illustration, and includes all changes, modifications, and reasonable equivalents which do not constitute a departure from the true spirit and scope of this invention as defined by the following claims.

What is claimed is:

1. A French fry cutter tool for use in a food processor of the type having an upright working bowl with tool drive means extending into the bowl for rotating various removable food processing tools in said bowl, a removable cover for closing the bowl when in use, and a feed passage for introducing food material into the bowl, said French fry cutter tool having a hub removably engageable with said drive means to be rotated thereby in a predetermined direction of rotation about an axis with a disc-like member secured to the hub for rotation therewith, said disc-like member having an opening therein extending from a region near said hub to a region near the periphery of said disc-like member, said opening being further defined by an elevated portion of said disc-like member located behind said opening, the novel French fry cutter tool comprising:

a cutting structure formed by a sharpened continuous strip of blade metal bent to form alternating spaced, flat lower portions and spaced, flat upper portions, interconnected by upright, spaced, parallel portions, said continuous blade strip having the general configuration of a sqaure wave with a sharpened leading edge, said flat, lower portions of said continuous blade strip being mounted to the underside of said disc-like member near the front edge of said opening in said disc-like member, said flat, upper portions of said continuous blade strip being mounted on said elevated portion of said disc-like member, said upright, spaced, parallel portions forming a plurality of spaced parallel vertical blades positioned in said opening and spaced radially with respect to said axis of rotation, said flat, upper portions of said continuous blade strip facing the direction of rotation of said disc forming a plurality of horizontally aligned blades which are elevated above the level of the top surface of said disc-like member, and horizontal blade means elevated above the level of said disc-like member for horizontally cutting the regions of food between said flat upper portions, whereby said blades in cooperation with the sharp leading edges of said elevated flat portions and said horizontal blade means produce French fry cuts from food items fed onto the rotating tool.

2. The French fry cutter tool as claimed in claim 1, in which:

said flat, upper portions of said bent continuous blade strip each has an integral tongue formed thereon extending rearwardly with respect to the direction of rotation of said tool, and means for securely mounting said tongues to said elevated portion of said disc-like member.

3. The French fry cutter tool as claimed in claim 2, in which:

said means for securely mounting said tongues to said elevated portion of said disc-like member is a flat plate-like blade projecting forwardly from said elevated portion of said disc-like member beneath said tongues, said plate-like blade element being secured to said disc-like member.

4. The French fry cutter tool as claimed in claim 3, in which:

said plate-like blade element rests upon and is secured to the elevated portion of said disc-like member.

5. The French fry cutter tool as claimed in claim 3 or 4, in which:

said tongues of said bent continuous blade strip are secured to the upper surface of said flat plate-like blade element, and the leading edge of said plate-like blade element is positioned against the trailing edges of said spaced, parallel, vertical blades.

6. The French fry cutter tool as claimed in claim 1, 2, 3 or 4, in which:

said flat, lower portions of said blade strip each has an integral tongue formed thereon extending rearwardly, said disc-like member has integral tongues thereon extending rearwardly into said opening, said disc tongues being aligned with and being secured to said tongues on said flat, lower portions of the bent blade strip.

7. The French fry cutter tool as claimed in claim 1, 2, 3 or 4, in which:

said blade strip is sharpened by grinding on only one side near its leading edge for forming a cutting edge on each flat upper portion of said strip which slopes forwardly upwardly with the forwardmost tip of the cutting edge being flush with the top surface of the flat upper portion.

8. The French fry cutter tool as claimed in claim 3 or 4, in which:

said plate-like blade element is sharpened by grinding on only one side near its leading edge for forming a cutting edge on said blade element which slopes forwardly and upwardly with the forwardmost tip of the cutting edge being flush with the top surface of said plate-like blade element.

9. A French fry cutter tool for use in a food processor of the type having an upright working bowl with tool drive means extending into the bowl for rotating various removable food processing tools in said bowl, a removable cover for closing the bowl when in use, and a feed passage for introducing food material into the bowl, said French fry cutter tool having a hub removably engageable with said drive means to be rotated thereby in a predetermined direction of rotation about an axis with a disc-like member secured to the hub for rotation therewith, said disc-like member having an opening therein extending from a region near said hub to a region near the periphery of said disc-like member, said opening being further defined by an elevated portion on said disc-like member located behind said opening, the novel French fry cutter tool comprising:

a cutting structure formed by a sharpened continuous strip of blade metal bent to form alternating spaced, flat lower portions and spaced, flat upper portions, interconnected by upright, spaced, parallel blade portions, said continuous blade strip having the general configuration of a square wave with a sharpened leading edge, said flat, lower portions of said blade strip having rearwardly extending lower tongues mounted to the underside of said disc-like member near the edge of said opening in said disc-like member, said edge of said disc-like member having integral rearwardly extending tongues to which said lower tongues of said blade strip are attached, said flat, upper portions of said blade strip having rearwardly extending upper tongues, a flat plate-like blade element having a sharpened leading edge mounted on the elevated portion of said disc-like member overlying said opening in said disc, said rearwardly extending upper tongues of said blade strip being mounted to the upper surface of said flat plate-like blade element, the sharp leading edge of said plate-like blade element being positioned adjacent to the trailing edges of said upright parallel blade portions, said upright, parallel blade portions forming a plurality of spaced parallel blades positioned in said opening and spaced radially with respect to said axis of rotation, and said blades in cooperation with the sharp leading edges of said flat upper portions and the sharpened leading edge of said flat plate-like blade element producing rectangularly shaped French fry cuts from food items fed onto the rotating tool.

10. A French fry cutter tool as claimed in claim 9, wherein said disc-like member has a downturned rim, and in which:

the outer end of said bent blade strip extends down adjacent to the inner surface of said rim and is secured to the rim.

11. A French fry cutter tool for use in a food processor having a rotatable disc-like member with an opening therein, said disc-like member being rotatable in a predetermined direction in the food processor and having a region behind said opening which is elevated above the level of said disc-like member, and a cutting structure associated with said opening comprising:

a continuous blade strip sharpened on its leading edge and being bent into a rectangular zig-zag configuration forming spaced, aligned horizontal lower portions, spaced, aligned, horizontal upper portions and spaced, parallel upright portions, said horizontal lower portions of said blade strip being secured to said disc-like member in front of said opening, said horizontal upper portions of said blade strip being supported by the elevated region of said disc-like member behind said opening, and horizontal cutting means elevated above the level of said disc-like member at approximately the same level as said horizontal upper portions, and said horizontal cutting means being located near said horizontal upper portions of said blade strip for horizontally cutting food material in locations between said horizontal upper portions.

12. A French fry cutter tool as claimed in claim 11, in which:

said horizontal cutting means is a plate-like blade secured to the elevated region of said disc-like member.

13. A French fry cutter tool as claimed in claim 11 or 12 in which:

said horizontal upper portions of said blade strip each has a rearwardly extending tongue, and said tongues being supported by said elevated region of said disc-like member.

14. A French fry cutter tool as claimed in claim 12, in which:

said horizontal upper portions of said blade strip each has a rearwardly extending tongue, and each of said tongues is attached to said plate-like blade.

15. A French fry cutter tool as claimed in claim 11, 12, or 14, in which:

said horizontal lower portions of said blade strip each has a tongue extending therefrom, and said tongues are attached to said disc-like member in front of said opening.

16. A French fry cutter tool as claimed in claim 15, in which:

said tongues extending from the lower portions of said blade strip are attached to the lower surface of said disc-like member in front of said opening.

* * * * *